US009581956B2

(12) United States Patent
Tamura et al.

(10) Patent No.: US 9,581,956 B2
(45) Date of Patent: Feb. 28, 2017

(54) IMAGE FORMING APPARATUS

(71) Applicant: KYOCERA Document Solutions Inc., Osaka (JP)

(72) Inventors: Takashi Tamura, Osaka (JP); Toshihiko Watanabe, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/045,872

(22) Filed: Feb. 17, 2016

(65) Prior Publication Data

US 2016/0246247 A1 Aug. 25, 2016

(30) Foreign Application Priority Data

Feb. 23, 2015 (JP) ..... 2015-033008
Feb. 23, 2015 (JP) ..... 2015-033010

(51) Int. Cl.
*G03G 21/16* (2006.01)
*G03G 21/18* (2006.01)

(52) U.S. Cl.
CPC ..... *G03G 21/1623* (2013.01); *G03G 21/1842* (2013.01)

(58) Field of Classification Search
None
See application file for complete search history.

(56) References Cited

U.S. PATENT DOCUMENTS 4,760,492 A * 7/1988 Walsh ..... H05F 3/02 312/223.3
5,315,350 A * 5/1994 Hirobe ..... G03G 15/2039 219/216
8,052,043 B1 * 11/2011 Douglass ..... G06Q 40/00 235/379

(Continued)

FOREIGN PATENT DOCUMENTS

JP H04109766 U 9/1992
JP H07281580 A 10/1995

(Continued)

OTHER PUBLICATIONS

Notice of Reasons for Refusal mailed by Japan Patent Office on Jul. 19, 2016 in the corresponding Japanese patent application No. 2015-033008.

*Primary Examiner* — David Gray
*Assistant Examiner* — Thomas Giampaolo, II
(74) *Attorney, Agent, or Firm* — IP Business Solutions, LLC

(57) ABSTRACT

An image forming apparatus includes an image forming section configured to form an image on a recording paper sheet and a housing accommodating the image forming section. The housing includes: an enclosed and bottomed housing body having an enclosed sidewall and a bottom formed continuously and integrally with the sidewall; and a lid removably attached to the housing body to cover an opening of the housing body. The image forming section is separate from the housing body and is placed on top of the (Continued)

bottom in the housing body. When the lid is removed from the image forming apparatus and the image forming section is lifted above the opening, the image forming section is taken out of the housing body through the opening and the housing body is removed from the image forming apparatus.

9 Claims, 8 Drawing Sheets

(56) References Cited

U.S. PATENT DOCUMENTS

| | | | | |
|---|---|---|---|---|
| 2010/0174613 | A1* | 7/2010 | Oram ..... | G06Q 20/20<br>705/17 |
| 2013/0128295 | A1 | 5/2013 | Matsushima | |

FOREIGN PATENT DOCUMENTS

| | | | |
|---|---|---|---|
| JP | H08-211680 | A | 8/1996 |
| JP | 2006037588 | A | 2/2006 |
| JP | 2006059945 | A | 3/2006 |
| JP | 2010002439 | A | 1/2010 |
| JP | 2013-109174 | A | 6/2013 |

* cited by examiner

IMAGE FORMING APPARATUS

INCORPORATION BY REFERENCE

This application claims priority to Japanese Patent Application No. 2015-033008 filed on Feb. 23, 2015, and Japanese Patent Application No. 2015-033010 filed on Feb. 23, 2015, the entire disclosure of which is incorporated herein by reference.

BACKGROUND

The present disclosure relates to image forming apparatuses capable of forming images on recording paper sheets and particularly relates to housings forming the shells of the image forming apparatuses.

Recently, there have been not only a growing demand to improve the performances of image forming apparatuses, such as the printing speed, but also a growing demand to improve the appearance designs thereof. To improve the designs of the image forming apparatuses, much ingenuity has been devoted to the housings forming the shells of the image forming apparatus in various ways.

SUMMARY

A technique improved over the above technique is proposed herein as one aspect of the present disclosure.

An image forming apparatus according to an aspect of the present disclosure is an image forming apparatus including an image forming section configured to form an image on a recording paper sheet and a housing accommodating the image forming section.

The housing includes: an enclosed and bottomed housing body having an enclosed sidewall and a bottom formed continuously and integrally with the sidewall; and a lid removably attached to the housing body to cover an opening of the housing body.

The image forming section is separate from the housing body and is placed on top of the bottom in the housing body.

When the lid is removed from the image forming apparatus and the image forming section is lifted above the opening, the image forming section is taken out of the housing body through the opening and the housing body is removed from the image forming apparatus.

DETAILED DESCRIPTION

Hereinafter, a description will be given of an image forming apparatus according to one embodiment of the present disclosure with reference to the drawings.

Figure 1:
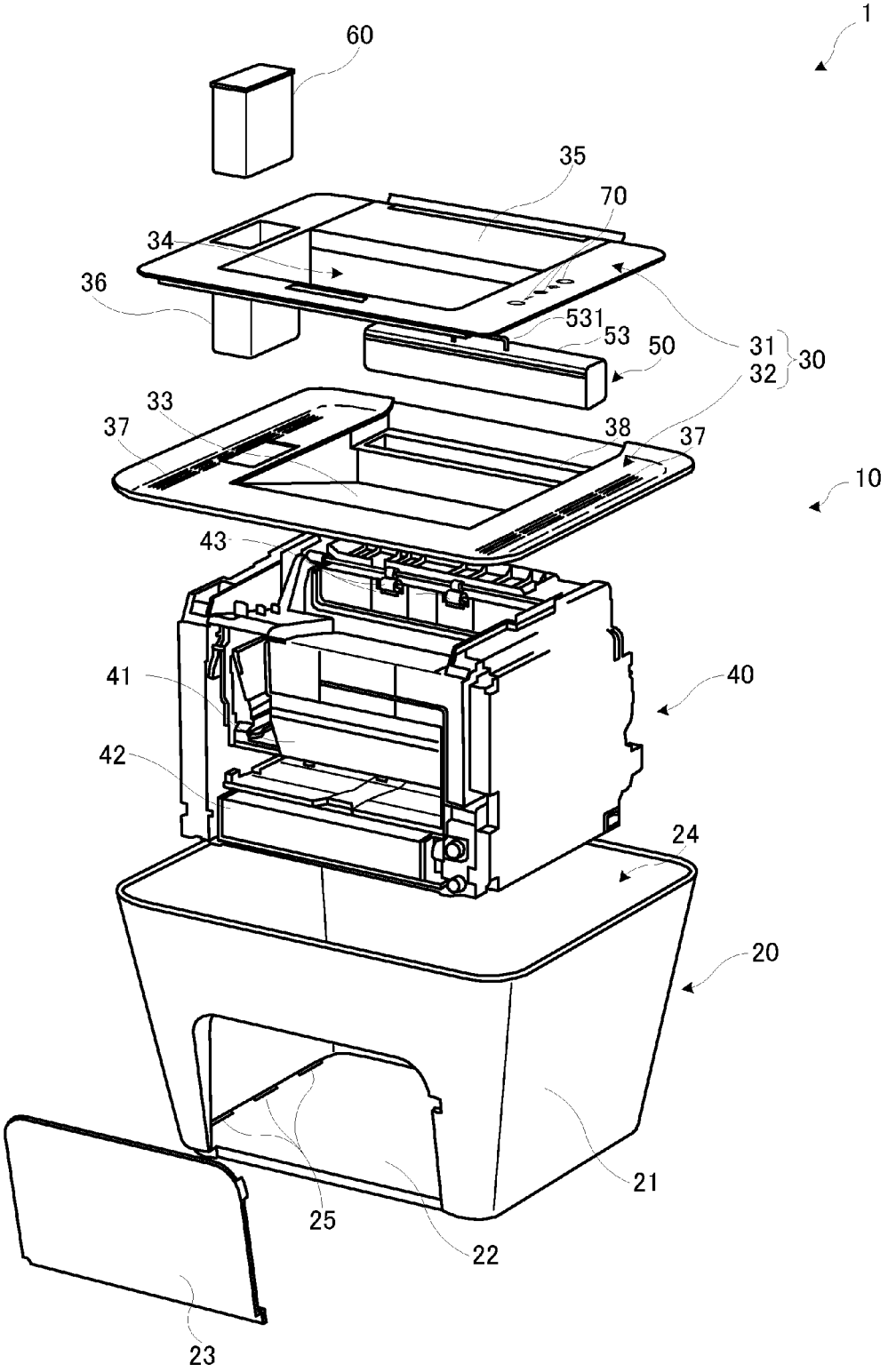
FIG. 1 is an exploded perspective view of an image forming apparatus according to one embodiment of the present disclosure.
Figure 2:
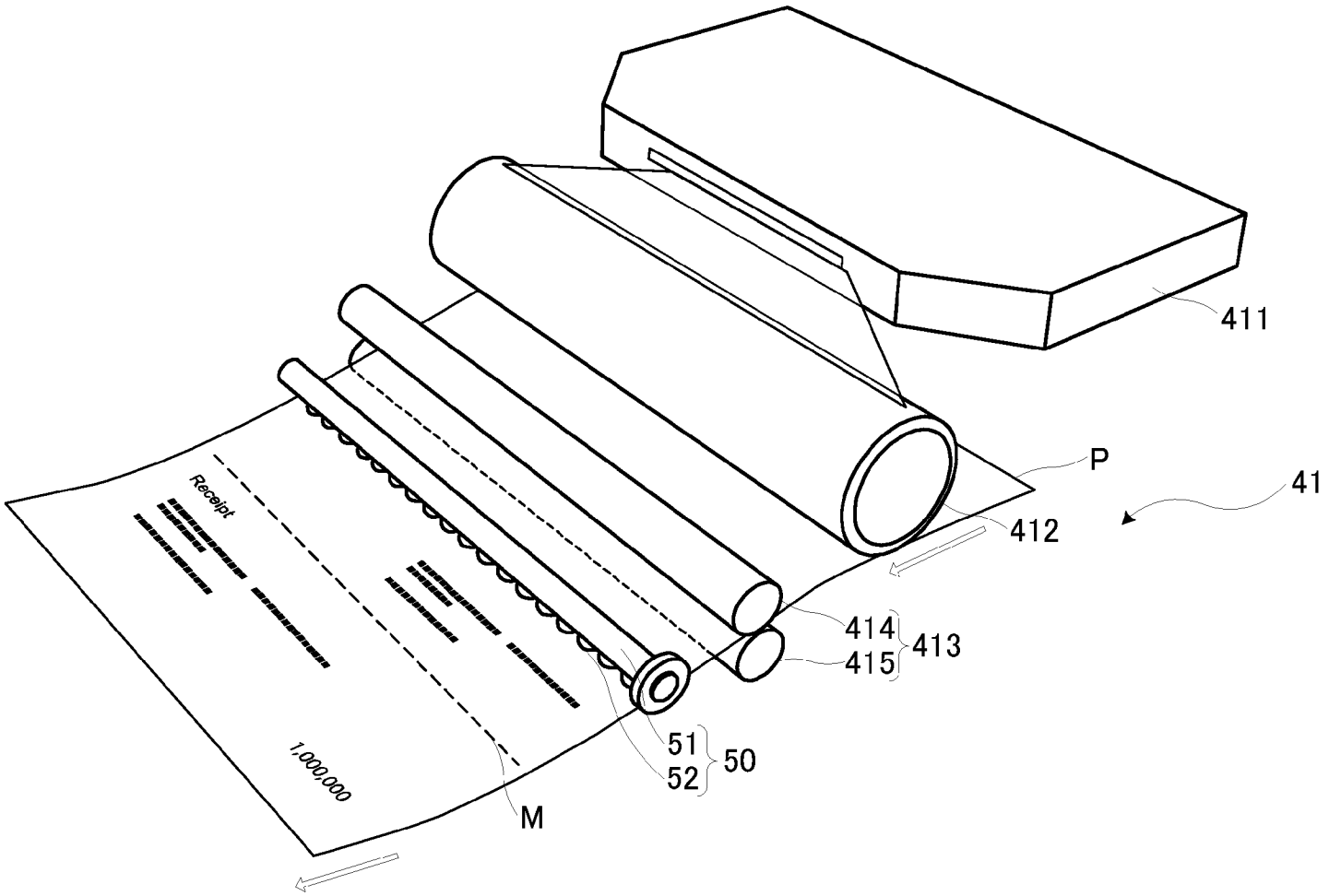
FIG. 2 is a view showing the structures of an image forming section and a perforating unit of the image forming apparatus according to the one embodiment of the present disclosure.

FIG. 1 is an exploded perspective view of an image forming apparatus 1 according to one embodiment of the present disclosure. FIG. 2 is a view showing the structures of an image forming section 41 and a perforating unit 50 of the image forming apparatus 1 according to the one embodiment of the present disclosure.

As shown in FIG. 1, the image forming apparatus 1 is roughly composed of a housing 10 forming a shell of the image forming apparatus 1 and contents, such as an image forming unit 40, a perforating unit 50, and a toner cartridge 60, contained in the housing 10. The image forming apparatus 1 includes, in addition to the image forming unit 40, the perforating unit 50, so that it can perform image formation processing for forming an image on a recording paper sheet and perforation processing for perforating the recording paper sheet.

In the image formation processing, first, a sheet feed section 42 of the image forming unit 40 conveys (feeds) a recording paper sheet accommodated in a recording paper sheet cassette located in the sheet feed section 42 toward an image forming section 41 of the image forming unit 40. The image forming section 41 includes, as shown in FIG. 2, a photosensitive drum 412, a charging device (not shown), an exposure device 411, a developing device (not shown), and so on and is configured to form a toner image, based on image data output from an external device, such as a PC, on the photosensitive drum 412 through charging, exposure, and development processes. The toner image formed on the photosensitive drum 412 is transferred to the recording paper sheet P having been conveyed along a recording paper sheet conveyance path. Then, the recording paper sheet P is subjected to fixation processing by a fixing unit 413 (fixing section) including: a heat roller 414 provided internally with a current-carrying heating element serving as a heating source; and a pressure roller 415 opposed to the heat roller 414.

The perforating unit 50 includes: a roller 51 having an axis of rotation extending in a direction perpendicular to a direction of conveyance of the recording paper sheet; and a cutting portion 52 in which a plurality of cutting teeth are linearly arranged on the peripheral surface of the roller 51 in the direction perpendicular to the direction of conveyance of the recording paper sheet. The roller 51 and the cutting portion 52 are accommodated in a housing 53 equipped with a handle portion 531 serving as a handle when a user inserts and removes the perforating unit 50 into and from a perforating unit holder 38 (see FIG. 1).

The roller 51 of the perforating unit 50 is driven into rotation by an unshown drive section. By the rotation of the roller 51, the cutting portion 52 switches between a state where it perforates the recording paper sheet P and a state where it does not perforate the recording paper sheet P. In this manner, a perforation line M is formed in the recording paper sheet P along the direction perpendicular to the direction of conveyance of the recording paper sheet.

The perforating unit 50 is disposed in the recording paper sheet conveyance path downstream of the image forming section 41 in the direction of conveyance of the recording paper sheet. More specifically, the perforating unit 50 is disposed downstream of the fixing unit 413 in the direction of conveyance of the recording paper sheet and upstream of a sheet discharge port, through which the recording paper sheet is to be discharged from the image forming apparatus 1, in the direction of conveyance of the recording paper sheet. Thus, the recording paper sheet having been conveyed along the recording paper sheet conveyance path is subjected to fixation processing, then perforated, and then discharged to the outside of the image forming apparatus 1 by a sheet output section 43.

Figure 3:
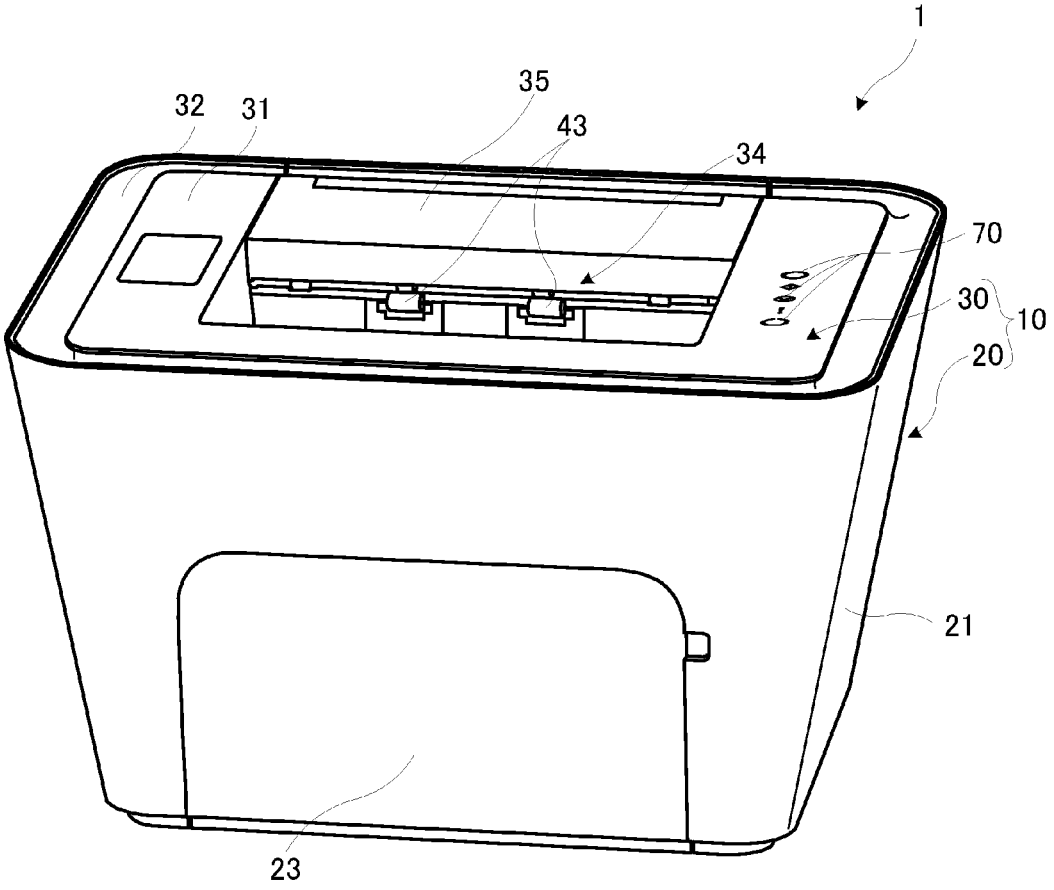
FIG. 3 is a perspective view of the image forming apparatus according to the one embodiment of the present disclosure as viewed from the front side.
Figure 4:
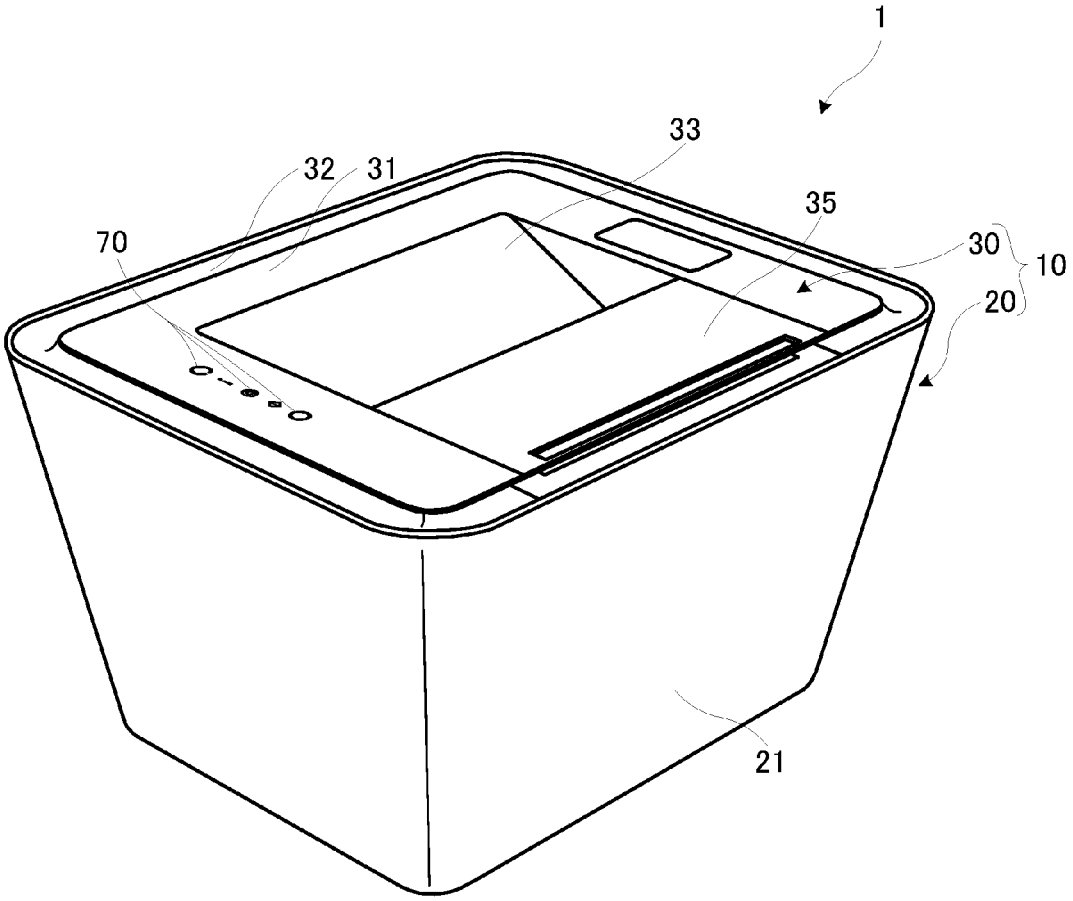
FIG. 4 is a perspective view of the image forming apparatus according to the one embodiment of the present disclosure as viewed from the back side.
Figure 5:
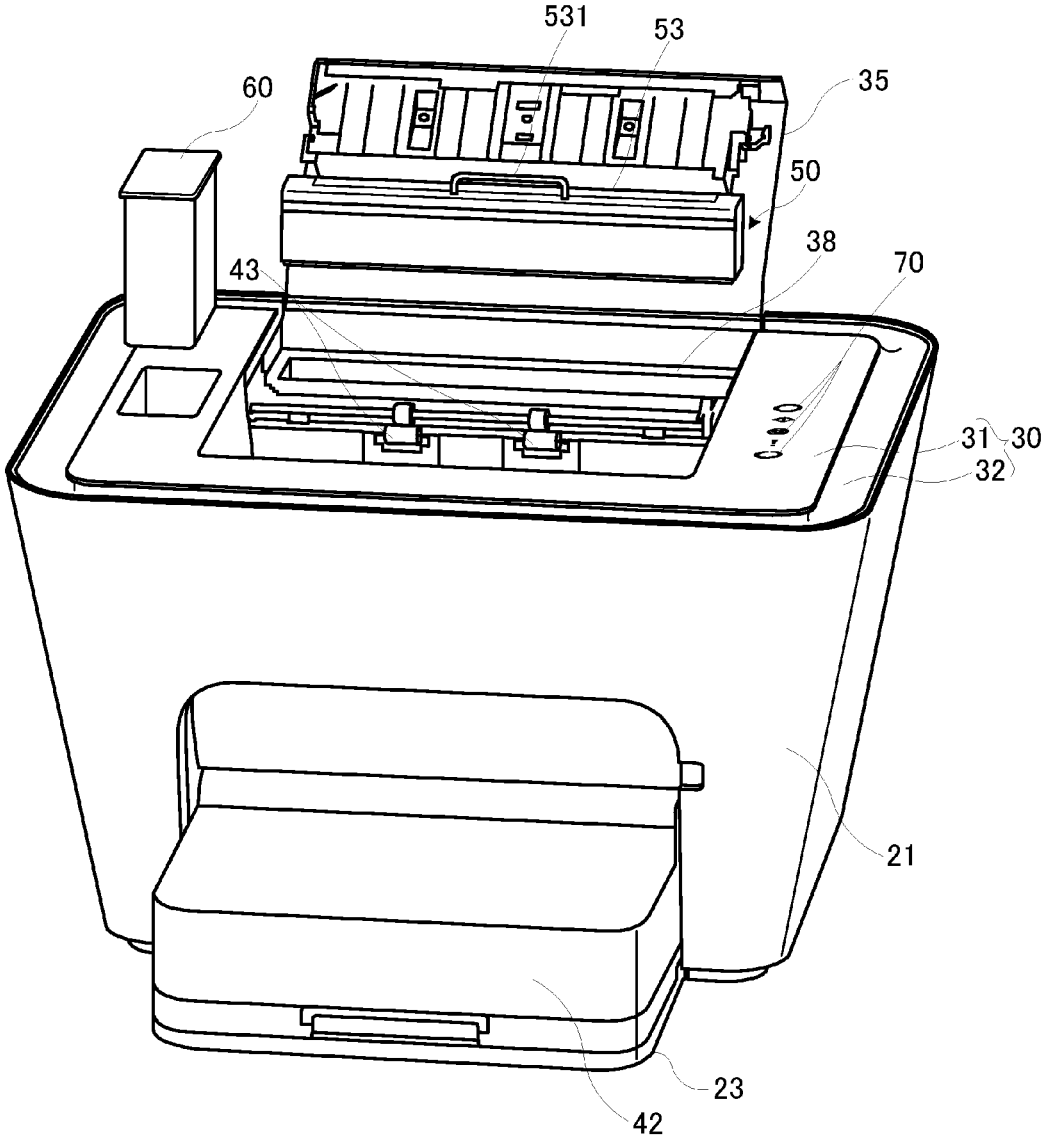
FIG. 5 is a perspective view showing a state where an openable portion and so on of the image forming apparatus according to the one embodiment of the present disclosure are open.
Figure 6:
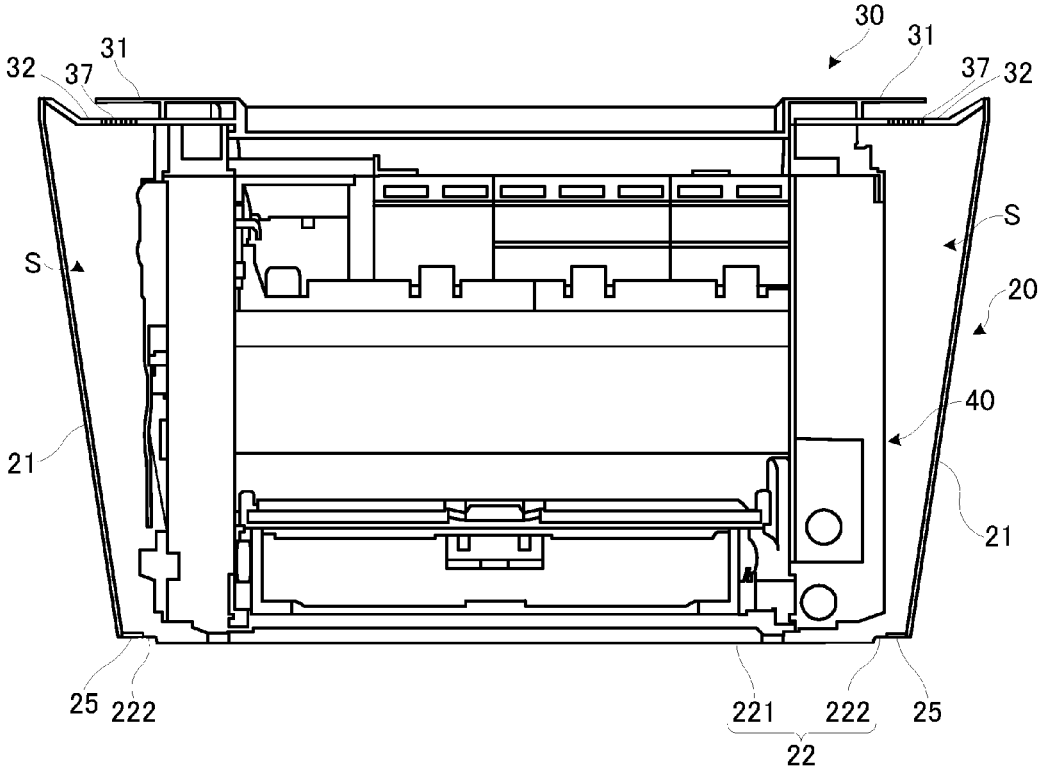
FIG. 6 is a cross-sectional view of the image forming apparatus according to the one embodiment of the present disclosure as viewed from the front side.
Figure 7:
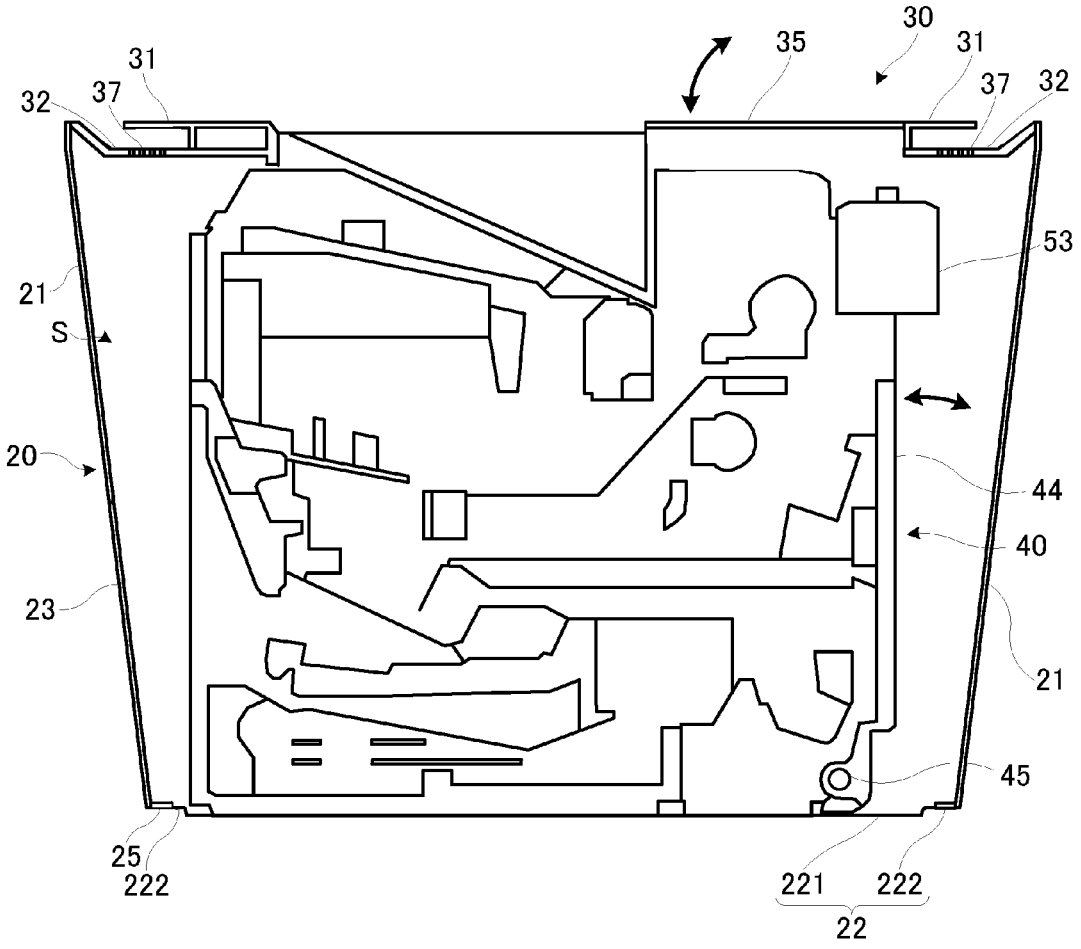
FIG. 7 is a cross-sectional view of the image forming apparatus according to the one embodiment of the present disclosure as viewed from the lateral side.
Figure 8:
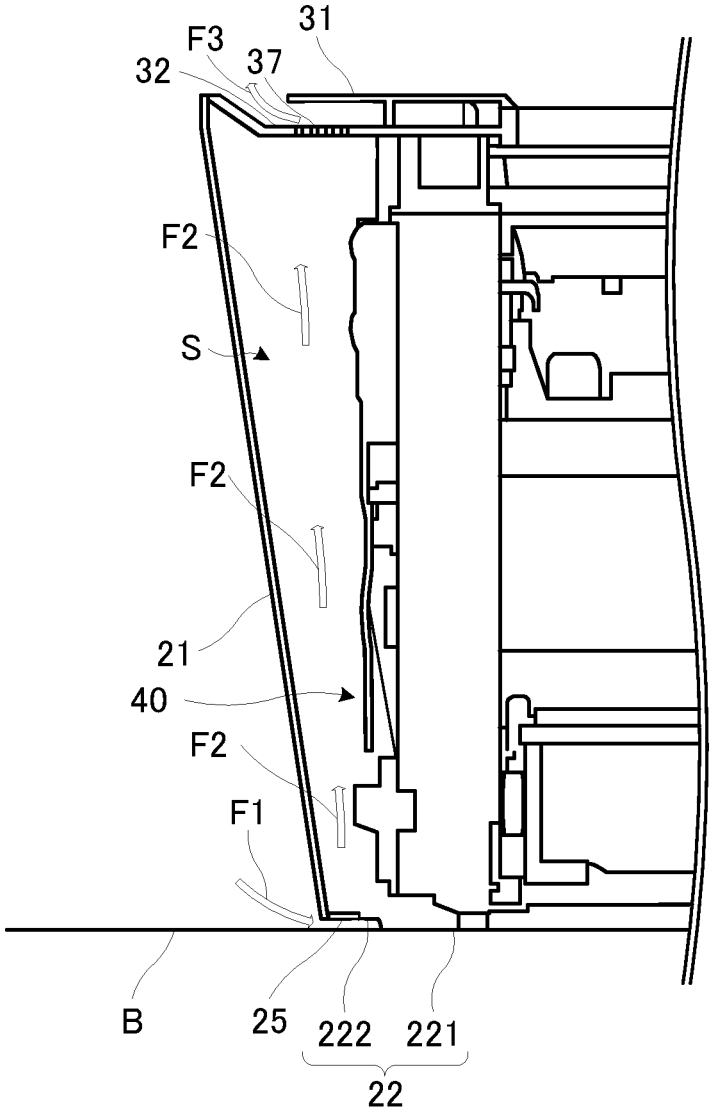
FIG. 8 is a view showing a flow of air in a housing of the image forming apparatus according to the one embodiment of the present disclosure.

FIG. 3 is a perspective view of the image forming apparatus 1 according to the one embodiment of the present disclosure as viewed from the front side. FIG. 4 is a perspective view of the image forming apparatus 1 according to the one embodiment of the present disclosure as viewed from the back side. FIG. 5 is a perspective view showing a state where an openable portion 35 and so on of the image forming apparatus 1 according to the one embodiment of the present disclosure are open. FIG. 6 is a cross-sectional view of the image forming apparatus 1 according to the one embodiment of the present disclosure as viewed from the front side. FIG. 7 is a cross-sectional view of the image forming apparatus 1 according to the one embodiment of the present disclosure as viewed from the lateral side. FIG. 8 is a view showing a flow of air in the housing 10 of the image forming apparatus 1 according to the one embodiment of the present disclosure. A description will be given below of the structure of the housing 10 accommodating the above-described image forming unit 40, perforating unit 50, and so on with principal reference to FIG. 1 and appropriate reference to FIGS. 3 to 8.

The housing 10 is composed of an enclosed and bottomed housing body 20 and a lid 30 covering an enclosed opening 24 of the housing body 20. The housing body 20 includes an approximately rectangular bottom 22 and an enclosed sidewall 21 formed continuously and integrally with the bottom 22. The sidewall 21 has an inclined shape spread outwardly with distance from the bottom 22 and, therefore, the housing 10 has an inverted trapezoidal shape the upper side of which is longer than the lower side as viewed from the lateral aspect (see FIGS. 3 and 4).

Furthermore, the sidewall 21 includes an openable portion 23 which is a portion of the sidewall 21 formed to be openable and closable. When the openable portion 23 is switched from a closed state (see FIG. 3) to an open state (see FIG. 5), the user becomes ready to load recording paper sheets into the sheet feed section 42 (recording paper sheet cassette) of the image forming unit 40 contained in the housing 10.

The bottom 22 is provided with louvers 25 (first louvers) serving as inlets through which air flows into the interior of the housing 10 from the outside of the housing 10. As shown in FIG. 6, the louvers 25 are formed in an outer edge portion 222 of the bottom 22 (at the junction at which the bottom 22 and the sidewall 21 join). The outer edge portion 222 is raised toward the lid 30 above a central portion 221 which is the remaining portion of the bottom 22 other than the outer edge portion 222. Therefore, when, as shown in FIG. 8, the image forming apparatus 1 is placed on a flat surface B (placement surface) of a floor, desk or the like, the central portion 221 of the bottom 22 is in contact with the flat surface B of the floor, desk or the like but the outer edge portion 222 of the bottom 22 is spaced from the flat surface B of the floor, desk or the like. Since, as just described, the outer edge portion 222 of the bottom 22 is spaced from the flat surface B of the floor, desk or the like, air can flow into the housing 10 through a gap formed between the outer edge portion 222 and the flat surface B and the louvers 25 (see the arrow F1 in FIG. 8). Furthermore, since the locations of the louvers 25 are not in the side surfaces of the housing 10 but in the bottom 22 thereof, the louvers 25 are less visible to the user.

Referring back to FIG. 1, the lid 30 is composed of two members: a first member 32 and a second member 31. The first member 32 has a depressed shape so that a marginal portion thereof is sunken below an outer edge thereof toward the bottom 22 of the housing body 20 (toward the side of the housing body 20 opposite to the opening 24). The marginal portion is provided with louvers 37 (second louvers) serving as outlets through which air is discharged out of the interior of the housing 10 to the outside of the housing 10.

Referring now to FIG. 6, the image forming unit 40 is separate from the housing body 20 and is placed on the central portion 221 of the bottom 22. Therefore, a space S is formed between the outer edge of the interior of the housing 10, i.e., the sidewall 21, and the image forming unit 40. As shown in FIG. 8, air having flowed into the housing 10 through the louvers 25 provided in the bottom 22 flows into the space S (see the arrow F1 in FIG. 8) and is then warmed by heat exchange with a heat source, such as the image forming unit 40, contained in the housing 10. The warmed air rises (see the arrow F2 in FIG. 8) and is then discharged to the outside through the louvers 37 provided in the lid 30 (see the arrow F3 in FIG. 8). In this manner, without provision of any fan in the interior of the housing 10, air flows from below (the bottom 22 side) to above (the lid 30 side) in the interior of the housing 10, so that an air passage (airflow path) connecting the louvers 25 and the louvers 37 is formed in the interior of the housing 10. Therefore, without provision of any fan in the interior of the housing 10, warmed air can be efficiently discharged to the outside of the image forming apparatus 1. In addition, since the sidewall 21 has an inclined shape spread outwardly with distance from the bottom 22, so that the space S serving as the airflow path gradually widens upward, the warmed air is less likely to be retained in the interior of the housing 10.

Since in the image forming apparatus 1 according to the one embodiment of the present disclosure, as just described, the louvers serving as the air inlets or outlets are provided in the bottom 22 and the lid 30 of the housing 10 to discharge warmed air to the outside of the image forming apparatus 1, there is no need to provide louvers in the sidewall 21 forming the side surfaces of the housing 10, unlike a general image forming apparatus. Therefore, in the image forming apparatus 1 according to the one embodiment of the present disclosure, the sidewall 21 is provided with no louver (see FIGS. 3 and 4). Hence, a major part of air warmed by the heat source, such as the image forming unit 40, i.e., the part of the warmed air other than a small amount of air discharged through a gap formed around the openable portion 23, rises in the space S without being discharged through the sidewall 21. During this, the air rising in the space S comes into contact with the sidewall 21, so that heat is drawn from the air by heat exchange with the sidewall 21. Furthermore, the sidewall 21 is in contact not only with the air in the space S but also with the air outside the image forming apparatus 1. Thus, the heat drawn from the air flowing in the space S by the sidewall 21 is dissipated to the outside of the image forming apparatus 1.

As described above, in the image forming apparatus 1 according to the one embodiment of the present disclosure, the image forming unit 40 or the like serving as a heat source is disposed in the central position of the interior of the housing 10 to form an airflow path in the marginal portion of the interior of the housing 10, so that the airflow path and the outside air are located with the sidewall 21 in between. Furthermore, in the image forming apparatus 1 according to the one embodiment of the present disclosure, the sidewall 21 is provided with no louver. Therefore, the sidewall 21 functions not as an air outlet but as a heat sink that draws heat from air rising in the space S and dissipates the drawn heat to the outside of the image forming apparatus 1. Thus, the heat discharge performance of the image forming apparatus 1 can be improved.

Since the sidewall 21 has an inclined shape spread outwardly with distance from the bottom 22, the area over which the sidewall 21 is in contact with the warmed air in the space S and the area over which the sidewall 21 is in contact with the outside air can be increased as compared with the case where the sidewall does not have such an inclined shape. Therefore, the heat dissipation performance of the sidewall 21 as the heat sink is high as compared with the case where the sidewall 21 does not have such an inclined shape.

The housing of a general image forming apparatus contains a large number of components (heat sources) producing heat during an image forming operation, such as a fixing section configured to fix an image formed on a recording paper sheet. Therefore, it is necessary to discharge the heat produced during the image forming operation to the outside of the housing.

In the general image forming apparatus, heat discharge is performed by providing louvers in the side surface of the housing and discharging heat warmed in the housing through the louvers. Because a simple provision of the louvers may cause the warmed air to be retained in the interior of the housing, fans are generally provided to efficiently discharge the warmed air through the louvers.

However, the louvers provided in the side surfaces of the housing are highly noticeable to the user, which is not desirable from the design viewpoint. Furthermore, if fans are provided in the interior of the housing, this makes the apparatus structure complicated.

Unlike the above, the image forming apparatus 1 according to this embodiment can discharge heat produced in the interior of the housing 10 with a simple structure and make the structure implementing heat discharge less likely to impair the apparatus design.

Referring back to FIG. 1, the central portion of the first member 32 includes a sunken portion 33 formed to be further sunken below the marginal portion toward the bottom 22 of the housing body 20. The sunken portion 33 is sloped and thus serves as a recording paper sheet tray on which recording paper sheets having images formed thereon and discharged from the sheet output section 43 of the image forming unit 40 are to be placed.

The first member 32 further includes the perforating unit holder 38 capable of accommodating the perforating unit 50. When the perforating unit 50 is accommodated in the perforating unit holder 38, the perforating unit 50 is held at a predetermined position along the recording paper sheet conveyance path in the housing 10. The perforating unit 50 is available in different cutting tooth sizes or different cutting tooth distances of the cutting portion 52. By opening the openable portion 35 of the second member 31, removing the perforating unit 50 from the perforating unit holder 38, and inserting a desired type of perforating unit 50 into the perforating unit holder 50 (see FIG. 5), the user can obtain recording paper sheets having images formed thereon and desired perforation lines formed therein. In this manner, the perforating unit 50 is provided to be free to be inserted into and removed from the apparatus body of the image forming apparatus 1.

Referring now to FIG. 7, a side surface of the image forming unit 40 is provided with a conveyance guide 44. The conveyance guide 44 is openable and closable in the direction of the arrows in FIG. 7 about a fulcrum 45 provided at the lower end thereof. When the conveyance guide 44 is open, the recording paper sheet conveyance path in the image forming unit 40 becomes exposed.

When the user opens the openable portion 35 of the second member 31 and removes the perforating unit 50 from the housing 10, a space accessible with the user's hand from the top to the interior of the housing 10 is formed. In the event of a paper jam, the user inserts his/her hand into the space and opens the conveyance guide 44. Thus, the user can perform the work of removing a recording paper sheet jammed in the recording paper sheet conveyance path (jam clearing). Since the sidewall 21 has an inclined shape spread outwardly with distance from the bottom 22, this makes it easy to perform the jam clearing during which the user's hand is inserted into the image forming unit 40 from above.

Referring back to FIG. 1, the second member 31 is disposed above the first member 32 and serves as a blinder covering at least the louvers 37 formed in the first member 32 to make them invisible to the user when seen from the opening 24 of the housing body 20. Thus, as shown in FIG. 8, with the image forming apparatus 1 placed on the flat surface B of a floor, a desk or the like, the louvers 37 are less visible to the user (see FIGS. 3 and 4) while air can be discharged through the louvers 37 to the outside (see the arrow F3 in FIG. 8). In addition, even when the user comes close to the image forming apparatus 1, the warmed air discharged through the louvers 37 to the outside of the apparatus is less likely to directly hit the user.

Furthermore, as shown in FIG. 8, the second member 31 serving as a blinder is located at the same height as the end of the sidewall 21 close to the lid 30. The louvers 37 are located closer to the bottom 22 in a height direction than the end of the sidewall 21 close to the lid 30. Thus, not only the second member 31 serving as a blinder hides the louvers 37 from view from above (the lid 30 side) but also the sidewall 21 hides the louvers 37 from view from the lateral side (the sidewall 21 side). Therefore, the louvers 37 are still less visible to the user. The second member 31 may not be located at the same height as the end of the sidewall 21 close to the lid 30 but may be located closer in height to the bottom 22 than the above end of the sidewall 21. Also in this case, the sidewall 21 hides the louvers 37 from view from the lateral side.

Referring back to FIG. 1, the second member 31 has an opening 34 formed in the center thereof. The opening 34 serves as a sheet discharge port through which a recording paper sheet having an image formed thereon by the image forming unit 40 is to be discharged to the outside of the apparatus.

Since the sheet discharge port through which the recording paper sheet having an image formed thereon is to be discharged is formed in the lid 30, the fixing unit 413 disposed near the sheet discharge port is located in a region of the interior of the housing 10 close to the lid 30. Since, as previously described, the space S serving as an airflow path gradually widens upward (toward the lid 30), a region of the space S around the fixing unit 413 is wide. Although the fixing unit 413 is a component producing the largest amount of heat among the components contained in the housing 10, the existence of the above-described wide region of the space S around the fixing unit 413 makes it less likely that heat released from the fixing unit 413 is retained in the interior of the housing 10 and enables the heat to be efficiently released to the outside of the image forming apparatus 1.

Furthermore, the second member 31 includes a toner cartridge holder 36 capable of accommodating a toner cartridge 60. When the toner cartridge 60 is accommodated in the toner cartridge holder 36 (see FIG. 5), the toner cartridge 60 is held at a predetermined position in the housing 10 and becomes ready to supply toner to a developing device (not shown) of the image forming section 41 of the image forming unit 40.

The second member 31 is further provided with an operating section 70 composed of physical keys, such as a power button, an OK button, and a cancel button. The user can input instructions relating to image formation or instructions relating to perforation to the image forming apparatus 1 with a press or the like on the operating section 70.

A further description will be given below of the appearance, shape, and so on of the housing 10. As previously described, the lid 30 is attached to the housing body 20 to cover the enclosed opening 24 of the housing body 20 and is removable from the housing 10.

As shown in FIG. 6, a gap is formed between the first member 32 and the second member 31 of the lid 30. The user can remove the lid 30 from the housing 10 by inserting his/her hands into the gap and lifting the lid 30. Specifically, the second member 31 of the lid 30 serves not only as a blinder covering the louvers 37 formed in the first member 32 but also as a handle that can be gripped by the user's hands in removing the lid 30 from the housing 10.

After the lid 30 is removed from the housing 10, the user can hold the image forming unit 40 placed on the central portion 221 of the bottom 22 and in turn take the image forming unit 40 out of the housing 10 through the opening 24. Since, as described previously, the sidewall 21 has an inclined shape spread outwardly with distance from the bottom 22 and, therefore, the opening 24 has a larger area than the bottom 22, the image forming unit 40 can be easily taken out of the housing 10. After the image forming unit 40 is removed from the housing 10, only the housing body 20 is left. In other words, the housing body 20 is removed from the image forming apparatus 1.

The housing body 20 is available in a variety of colors. The user can select a housing body 20 having a desired color and accommodate the removed image forming unit 40 in the selected housing body 20. Then, the lid 30 is attached to the housing body 20, resulting in completion of the assembly of the image forming apparatus 1. Since, as described above, the housing body 20 has an enclosed and bottomed shape in which an enclosed sidewall 21 and a bottom 22 are formed continuously and integrally, the housing body 20 can be replaced with another housing body in a simple process of taking the image forming unit 40 out of the enclosed and bottomed housing body 20.

The preference for the appearance design of the image forming apparatus often varies from user to user. Particularly, the preference for the color of the housing forming the shell of the image forming apparatus generally varies from user to user. Furthermore, the color suitable for the housing varies depending on the location and type of usage of the image forming apparatus. In view of these points, it can be considered to sell image forming apparatuses in a variety of colors according to the user's color preference, location, and type of usage. In this case, however, there arises a problem that even when the user's color preference, location or type of usage changes after the purchase of the image forming apparatus, it is not possible to change the color of the housing.

In this regard, the housing 10 of the image forming apparatus 1 according to the above embodiment can be replaced with another housing having a user-desired color in a simple process. Furthermore, the sidewall 21 forming the side surfaces of the image forming apparatus 1 is highly visible and has a significant effect on the general design of the image forming apparatus 1. The user can significantly change the general design of the image forming apparatus 1 by replacing the housing body 20 with another housing body 20 having a desired color.

Furthermore, the housing body 20 is made of a resin material, such as polycarbonate. The housing body 20 is produced, for example, by injection molding the resin material. Since the housing body 20 does not have a complicated shape but has a very simple shape, the production cost can be reduced. In addition, because housing bodies 20 of different colors can be produced by mixing different pigments into the resin material, such as polycarbonate, the production cost can be reduced as compared with the case where the color of the housing body 20 is changed by coating. Therefore, housing bodies 20 of a variety of colors can be offered to users at low cost.

As shown in FIGS. 3 and 4, the sidewall 21 of the housing body 20 is provided with no louver. Furthermore, the operating section 70 composed of physical keys are provided on the lid 30, not on the sidewall 21. As seen from these points, the sidewall 21 of the housing body 20 is formed by flat surfaces with no irregularities, such as projections, grooves, recesses, and holes, except for the openable portion 23. In a general image forming apparatus, the side surfaces thereof highly visible to the user are provided with louvers or the like serving as air inlets or outlets, which significantly impairs the appearance design. Unlike this, the image forming apparatus 1 according to the above embodiment of the present disclosure has a structure in which heat can be discharged without the need to provide the louvers serving as air inlets or outlets in the sidewall 21. Therefore, the number of irregularities, such as projections, grooves, recesses, and holes, on or in the sidewall 21 can be reduced as much as possible. Thus, the image forming apparatus 1 can achieve a flat design in which the sidewall 21 is formed by flat surfaces and can have high design quality.

As described previously, in the image forming apparatus 1 according to the above embodiment of the present disclosure, the louvers 25 provided as air inlets in the bottom 22 and the louvers 37 provided as air outlets in the lid 30 can be made less visible to the user. Therefore, the louvers 25 and louvers 37 are less likely to impair the design of the image forming apparatus 1.

The present disclosure is not limited to the above embodiment and can be modified in various ways.

For example, the lid 30 may be configured to be capable of connection with the image forming unit 40. Thus, when the user holds the second member 31 of the lid 30 as a handle and removes the lid 30 from the housing 10, the image forming unit 40 can be removed together with the lid 30 from the housing 10. Since thus the lid 30 and the image forming unit 40 can be removed in a single process, the number of processes necessary in replacing the housing body 20 can be reduced.

Alternatively, the image forming apparatus 1 may be configured not to provide the openable portion 23 in the sidewall 21 of the housing body 20. Thus, the number of irregularities, such as projections, grooves, recesses, and holes, on or in the sidewall 21 highly visible to the user can be further reduced. In this case, for example, an alternative to the openable portion 23 is provided in the lid 30.

The description in the above embodiment with reference to FIGS. 1, 3, and 4 has been given of the case where all of four surfaces forming the enclosed sidewall 21 have inclined shapes spread outwardly with distance from the bottom 22. However, the present disclosure is not necessarily limited to this case. So long as at least one of a plurality of surfaces forming the sidewall 21 has an inclined shape spread outwardly with distance from the bottom 22, the above-described heat release effect of making warmed air less likely to be retained in the housing 10 and the above-described workability effect of making the image forming unit 40 easy to take out of the housing 10 can be produced.

Although the description in the above embodiment has been given of the case where jam clearing is performed by inserting the user's hand from above into the space formed in the interior of the housing 10 when the user opens the openable portion 35 of the second member 31 and takes the perforating unit 50 out of the housing 10, the present disclosure is not necessarily limited to this case. The back side of the sidewall 21 may be provided with an openable portion formed to be openable and closable as a portion of the sidewall 21. When the user opens the openable portion, the conveyance guide 44 becomes exposed, so that the user becomes ready to perform jam clearing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising an image forming section configured to form an image on a recording paper sheet and a housing accommodating the image forming section, the housing comprising:

an enclosed and bottomed housing body having an enclosed sidewall and a bottom formed continuously and integrally with the sidewalk; and a lid removably attached to the housing body to cover an opening of the housing body, wherein the image forming section is separate from the housing body and is placed on top of the bottom in the housing body, when the lid is removed from the housing body and the image forming section is lifted above the opening, the image forming section is taken out of the housing body through the opening, the bottom is formed so that when the image forming apparatus is placed on a placement surface, a portion of the bottom is spaced from the placement surface, a first louver serving as an air inlet is provided in the portion of the bottom spaced from the placement surface, a second louver serving as an air outlet is provided in the lid, the sidewall is free of louver serving as an air inlet or air outlet, and a space formed in an interior of the housing between the sidewall and the image forming section provides a flow path of air flowing from the bottom to the lid.

2. The image forming apparatus according to claim 1, wherein the sidewall functions as a heat sink that, while air warmed by heat production of the image forming section during operation of the image forming apparatus flows in the space from the bottom to the lid, draws heat from the warmed air and releases the drawn heat to the outside of the image forming apparatus.

3. The image forming apparatus according to claim 2, wherein at least one of a plurality of surfaces forming the enclosed sidewall has an inclined shape spread outwardly with distance from the bottom, and the space formed in the interior of the housing between the sidewall and the image forming section widens with distance from the bottom.

4. The image forming apparatus according to claim 3, wherein the image forming section includes a fixing section configured to fix the image formed on the recording paper sheet, a sheet discharge port through which the recording paper sheet having the image formed thereon is to be discharged is formed in the lid, and the fixing section is disposed in a region of the interior of the housing close to the lid.

5. The image forming apparatus according to claim 1, wherein the lid includes a blinder covering at least the second louver as viewed from the opening and the blinder serves as a handle capable of being gripped by user's hands in removing the lid from the image forming apparatus.

6. The image forming apparatus according to claim 5, wherein the lid has a depressed shape so that a marginal portion of the lid is sunken below an outer edge of the lid toward the bottom, the second louver is provided in the marginal portion having the depressed shape, the second louver is located closer to the bottom in a height direction than an end of the sidewall close to the opening, and the blinder is located at the same height as the end of the sidewall close to the opening or located closer to the bottom in the height direction than the end of the sidewall close to the opening.

7. The image forming apparatus according to claim 6, wherein the portion of the bottom spaced from the placement surface is an outer edge portion of the bottom, and the outer edge portion of the bottom is raised above the remaining portion of the bottom toward the lid.

8. The image forming apparatus according to claim 1, wherein the sidewall includes an openable portion which is a portion of the sidewall formed to be openable and closable, and when the openable portion is switched from a closed state to an open state, the image forming apparatus is capable of receiving recording paper sheets in a recording paper sheet cassette contained in the housing.

9. The image forming apparatus according to claim 1, wherein the housing body is made of a resin material.

* * * * *